United States Patent [19]

Brühlmeier

[11] 3,968,936

[45] July 13, 1976

[54] AIR OUTLET APPARATUS

[75] Inventor: Josef Brühlmeier, Wettingen, Switzerland

[73] Assignee: Luwa AG, Zurich, Switzerland

[22] Filed: Sept. 30, 1974

[21] Appl. No.: 510,429

[30] Foreign Application Priority Data

Oct. 8, 1973 Switzerland ..... 14306/73

[52] U.S. Cl. ..... 239/550; 239/557; 98/40 N

[51] Int. Cl.[2] ..... B05B 1/14

[58] Field of Search ..... 165/123; 98/40 N, 38, 98/38 E, 38 EI; 239/550, 557, 558, 556, 559, 560, 600, 602; 285/396; 220/293, 302

[56] References Cited

UNITED STATES PATENTS

| | | | |
|---|---|---|---|
| 1,241,032 | 9/1917 | Schneider | 239/550 |
| 1,643,607 | 9/1927 | Kielberg | 239/557 X |
| 3,411,572 | 11/1968 | Honnold, Jr. | 165/123 |
| 3,503,554 | 3/1970 | Clifton | 239/550 X |
| 3,799,453 | 3/1974 | Hart | 239/600 |

*Primary Examiner*—John J. Love
*Attorney, Agent, or Firm*—Werner W. Kleeman

[57] ABSTRACT

An air outlet apparatus with a plate bounding an air compartment or chamber, and carrying nozzles protruding from the plate. The plate possesses openings distributively arranged over the length thereof, each of which openings is sealingly occupied by a respective detachably secured nozzle block, and wherein each nozzle block contains a number of nozzles.

5 Claims, 4 Drawing Figures

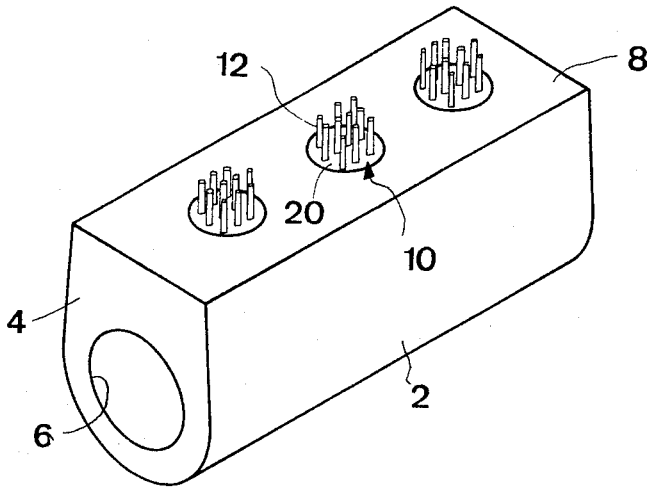
Fig.1
Fig.3a
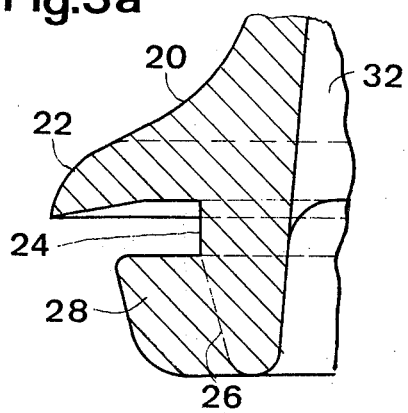
Fig.3b
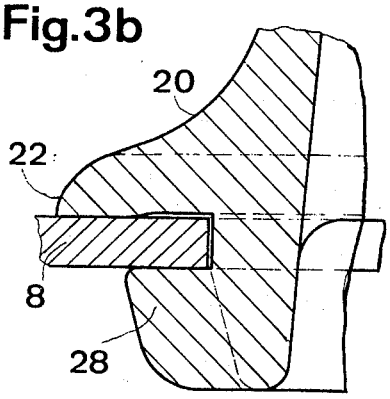
Fig.2
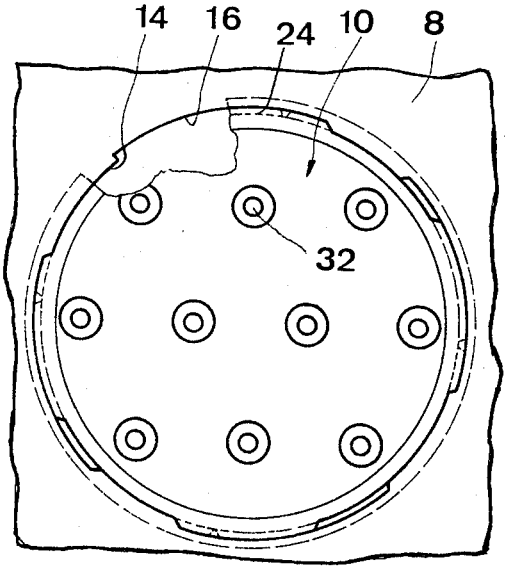

AIR OUTLET APPARATUS

BACKGROUND OF THE INVENTION

The present invention relates to a new and improved air outlet apparatus especially for induction climatizing devices with a plate bounding an air compartment or chamber and which carries nozzles protruding from the plate.

In the case of induction climatizing devices the primary air compartment is generally formed by a box or housing arranged in the induction climatizing device, which is arranged between the inlet opening for the secondary air sucked-up out of the room and the outlet opening for the mixed air stream formed by the primary air and secondary air. In order that the required intensive admixing of the primary air with the secondary air already occurs in the climatizing or air conditioning device, it is necessary to suck-up as large as possible quantity of secondary air into the climatizing device with the quantity of primary air which is available. Among other things, this again has as the prerequisite that the primary air which is available is brought to the outlet distributed as uniformly as possible over the length of the housing or box which is equipped with nozzles. In order to prevent on the one hand that for each determined quantity of air there is necessary a specific housing length which should be available and, on the other hand, to ensure that during the regulation or adjustment of the climatizing device, notwithstanding deviations of the actual quantity of air which is available in contrast to the calculated quantity of air, there is realized the required uniform distribution of the air, it is known to construct the plate closing the primary air compartment and which carries the primary air nozzles so as to be exchangeable, in order that, depending upon the requirements, there can be employed plates with different numbers of nozzles or different nozzle diameters. Since the length of such primary air housings likewise varies there has already been known an outlet device wherein the plate carrying the nozzles is sub-divided in the lengthwise direction into a number of partial sections or pieces, so that depending upon the length of the housing or the primary air compartment there can be employed a larger or smaller number of plate sections or parts.

What is disadvantageous with this construction is especially the fact that the exchange of the plates, that is to say, that the dismantling or mounting is relatively complicated. Between the housing and the plate there must be produced an airtight connection, in order to prevent unnecessary noises with respect to the outlet of the air at the joint or separation location between the plate sections or parts and the air housing or between the individual plate sections.

According to another prior art construction there are provided individual nozzles which are formed of soft, resilient plastic or rubber, since for exchange purposes they must be deformable. These nozzles sealingly bear at the wall of the primary air housing or box, in other words do not require any special sealing, but cannot be fabricated from metal and furthermore do not fulfill certain requirements with regard to fire protection.

SUMMARY OF THE INVENTION

Hence, it is a primary object of the present invention to provide an improved air outlet apparatus which avoids the aforementioned drawbacks and which can be fabricated and used both from plastic as well as metal.

The inventive apparatus is manifested by the features that the plate possesses openings which are distributively arranged over its length, each of which is sealingly occupied by a detachably secured nozzle block, wherein each nozzle block contains a number of nozzles.

Preferably the nozzle blocks are constructed to be insertable into the plates in the manner of quick closure devices or, however, are equipped with such quick closure devices. For instance, it is possible to construct the nozzle block with a limited elastically deformable connection portion which when deformed can be inserted into an opening of the plate and by elastic restoration engages therein.

The detachable connection of the nozzle block into the plate ensures in any event for the exchange of such nozzle blocks in a very simple manner, for instance with one hand and with minimum expenditure in cost, wherein such exchange not only comes into consideration for the purpose of accommodating or matching the system to certain air-pressure or quantity relationships, rather also for replacement in the case of damage of the nozzles or during exchange of devices upon the mounting of the devices in buildings. Furthermore, this type of nozzle construction and arrangement allows for retaining in storage prefabricated devices, facilitating the control of the production. Equipping of the devices with nozzles according to the requirements of a customer can then take place in a very simple manner.

BRIEF DESCRIPTION OF THE DRAWING

The invention will be better understood and objects other than those set forth above, will become apparent when consideration is given to the following detailed description thereof. Such description makes reference to the annexed drawing wherein:

FIG. 1 is a schematic perspective view of a primary air-outlet apparatus;

FIG. 2 is a plan view of the underside of a nozzle block; and

FIGS. 3*a* and 3*b* each are vertical sections through a marginal portion of a nozzle block in the dismantled and mounted state respectively.

DETAILED DESCRIPTION OF THE PREFERRED EMBODIMENTS

Describing now the drawing, in FIG. 1 reference numeral 2 designates a primary air-distributor housing or box of an induction climatizing device which contains internally a primary air-distributor compartment and the end wall 4 possesses an opening 6 for the connection of a not particularly illustrated primary air conduit which is connected with a central air conditioning or climatizing system. The top side of the distributor housing 2 is formed by a planar rectangular-shaped plate 8 which carries nozzle blocks 10. Each nozzle block 10 possesses a number of nozzles 12 which extend at right angles away from the plate 8, and which are connected with the primary air compartment within the housing 2.

As best seen by referring to FIGS. 2 and 3*a* and 3*b*, each nozzle block is inserted in a substantially circular-shaped opening 14 provided in the plate 8, at the periphery of which there are provided four uniformly distributed segment-shaped recesses 16. Each nozzle block possesses a flange 20 which tapers radially towards the outside and terminates in an elastically deformable sealing lip 22.

At the flange 20 there merges in axial direction a cylindrical section 24, the diameter of which is somewhat smaller than the diameter of the opening 14 in the plate 8. At the cylindrical portion 24 there merges in axial direction a conically tapered portion 26, which carries four cams or projections 28 which are uniformly distributed about its periphery. The cams or projections 28, as concerns their extension in the peripheral direction and with respect to their radial extension, are constructed such that upon insertion of a nozzle block 10 into the opening 14 there is possible a throughpassage of such projections or cams through the recesses 16. In order that the cams or projections 28 while rotating the nozzle block inserted into the opening 14 can be brought to engage at the underside of the plate 8, the sealing lip 22 must be deformed by a certain amount by axial pressure. Corresponding to such deformation the sealing lip bears in the engaged state of the cams with a pre-stressed at the top side or surface of the plate 8.

In this way there is avoided an escape of air out of the primary air compartment except through the bores 32 of the nozzles 30 of the nozzle block.

In the event that such is desired for the further simplification of the mounting of the nozzle block the cams or projections 28 can possess at their side confronting the flange 20 a taper in the peripheral direction, so that there can be attained the required pre-stress first upon rotating through a certain angle, In FIG. 3*b* the sealing lip 22 has been illustrated in its pre-stress state, whereas in FIG. 3*a* there is illustrated the non-stressed state.

The nozzle blocks used in the illustrated exemplary embodiment can be formed of plastic or metal and are for instance produced in an injection molding process.

As will be apparent from what has been discussed above the nozzle blocks can be exchanged in a very simple manner both for the purpose of accommodating the climatizing device to a given quantity of air and for attaining a predetermined pressure, without there existing the danger that upon renewed mounting there will appear leakage locations at the connection location between the nozzle block and the air housing or box. Due to the distribution of the nozzle arrangement of a primary air-outlet mechanism into nozzle blocks of the previously described type it is possible to maintain predetermined values concerning air quantities and air pressure, without having to strive for complicated special constructions. Also the maintaining and storage of the air housings or boxes is simplified in that, if desired, one of the openings in the air housing or box can be covered by a blind or false piece in the event that the entire box or housing length is not needed for the escape of primary air. The nozzle blocks themselves need only be available in a few different constructions, for instance with regard to the nozzle diameter or with respect to the number of nozzles per nozzle block, whereby in an air housing it is possible to simultaneously insert nozzle blocks which are different with regard to the nozzle number and/or nozzle diameter.

It is of course also conceivable that the individual nozzles of a nozzle block do not extend in parallelism to one another and/or that the nozzles form an acute angle with respect to the plate.

The described air outlet apparatus is readily suitable also for other devices and equipment in which there is present the function of permitting air to escape via a large surface in a uniform distribution out of a hollow compartment, provided that air is delivered to the hollow compartment or space with a corresponding excess pressure.

While there is shown and described present preferred embodiments of the invention, it is to be distinctly understood that the invention is not limited thereto but may be otherwise variously embodied and practiced within the scope of the following claims. Accordingly,

What is claimed is:

1. An air outlet apparatus comprising an air compartment, a plate bounding said air compartment, said plate being provided with openings distributively arranged over its length, each of the openings in the plate possessing an essentially circular-shaped configuration and bounded by an edge means, each of said openings being sealingly occupied by a detachably secured nozzle block, each nozzle block containing a number of protruding nozzles, each nozzle block possessing a flange which engages over the plate and cam means which engage beneath the plate for detachably securing each nozzle block inserted into one of said openings at the plate, the cam means of each nozzle block being formed at the region of a substantially cylindrical portion of the nozzle block which is bounded in axial direction by the flange, and each of the edge means bounding the associated opening in the plate possess recesses which permit the throughpassage of the cam means.

2. The apparatus as defined in claim 1, wherein the cam means are rotatable about an axis of rotation extending substantially in the same direction as the direction of outflow of air through the protruding nozzles of each nozzle block for selectively connecting and disconnecting each nozzle block from the plate.

3. The apparatus as defined in claim 1, wherein said flange forms an elastically deformable sealing lip which bears with a pre-stress at the plate.

4. The apparatus as defined in claim 1, wherein said nozzle block is formed of plastic.

5. The apparatus as defined in claim 1, wherein the nozzle block is formed of metal.

* * * * *